US009155374B2

(12) United States Patent
Kacmarcik

(10) Patent No.: US 9,155,374 B2
(45) Date of Patent: Oct. 13, 2015

(54) FIRE EXTINGUISHER HARNESS

(75) Inventor: Robert Kacmarcik, Farmington, CT (US)

(73) Assignee: UTC FIRE & SECURITY CORPORATION, Farmington, CT (US)

( * ) Notice: Subject to any disclaimer, the term of this patent is extended or adjusted under 35 U.S.C. 154(b) by 230 days.

(21) Appl. No.: 13/879,272

(22) PCT Filed: Oct. 12, 2010

(86) PCT No.: PCT/US2010/052301
§ 371 (c)(1),
(2), (4) Date: Sep. 6, 2013

(87) PCT Pub. No.: WO2012/050566
PCT Pub. Date: Apr. 19, 2012

(65) Prior Publication Data
US 2013/0341369 A1 Dec. 26, 2013

(51) Int. Cl.
*A62C 15/00* (2006.01)
*A45F 3/14* (2006.01)

(52) U.S. Cl.
CPC ..... *A45F 3/14* (2013.01); *A45F 2003/146* (2013.01); *A62C 15/00* (2013.01)

(58) Field of Classification Search
CPC ..... A45F 3/14; A45F 2003/144; A45F 2003/146; A45F 2003/166; A62C 15/00
USPC ..... 224/260
See application file for complete search history.

(56) References Cited

U.S. PATENT DOCUMENTS 4,600,134 A * 7/1986 Colby ..... 224/260
4,993,612 A * 2/1991 Quimby et al. ..... 224/160
5,255,947 A * 10/1993 Schwartz ..... 294/31.2
5,624,065 A * 4/1997 Steffe ..... 224/625
5,690,261 A * 11/1997 Moore ..... 224/578
5,913,464 A * 6/1999 Haberlein ..... 224/259
5,979,727 A 11/1999 Steurer
6,152,343 A * 11/2000 Shin ..... 224/645
6,568,575 B1 * 5/2003 Bartholomew ..... 224/583
8,356,692 B1 * 1/2013 Steck et al. ..... 182/3
8,657,166 B1 * 2/2014 Harness ..... 224/259
2002/0145027 A1 * 10/2002 Godshaw et al. ..... 224/605
2003/0102344 A1 6/2003 Godshaw et al.
2004/0149790 A1 * 8/2004 Kassai et al. ..... 224/160
2005/0000994 A1 1/2005 Rundberg
2005/0155996 A1 * 7/2005 Hiscocks ..... 224/160
2005/0205633 A1 * 9/2005 Godshaw et al. ..... 224/625
2008/0190972 A1 * 8/2008 Gray ..... 224/160
2009/0071990 A1 * 3/2009 Jardine et al. ..... 224/155
2009/0090754 A1 * 4/2009 Haberlein ..... 224/262
2009/0159364 A1 * 6/2009 O'Brien ..... 182/3
2013/0277408 A1 * 10/2013 Kamo et al. ..... 224/639
2014/0131411 A1 * 5/2014 McBride ..... 224/600

* cited by examiner

*Primary Examiner* — Brian D Nash
(74) *Attorney, Agent, or Firm* — Cantor Colburn LLP

(57) ABSTRACT

A wearable equipment carrier comprises a first receptacle for retaining a first set of equipment, a lower load bearing section, and an upper load stabilizing section. The lower load bearing section includes a belt for detachably securing the first receptacle to a lower abdominal region of a person. The belt is engaged with a middle portion of the first receptacle for transferring a majority of weight in the first receptacle through the belt to the lower abdominal region during a time that the belt is secured to the person. The upper load stabilizing section includes a first shoulder strap for orienting and laterally stabilizing the first receptacle substantially along a forward walking direction. The first shoulder strap has a forward end for engaging with a top portion of the first receptacle, and a distal end for engaging with a bottom portion of the first receptacle.

20 Claims, 9 Drawing Sheets

FIRE EXTINGUISHER HARNESS

BACKGROUND

This invention relates generally to devices for transporting equipment, and more specifically to a device for transporting equipment about a person's body.

Service and delivery personnel can be tasked with carrying heavy or bulky objects between their vehicle and the delivery or pick-up site. Negotiation of obstacles can be difficult or impossible when carrying one or more heavy or bulky objects by hand. Many times, distance, terrain, or the presence of obstacles like closed doors, curbs, stairs, and even elevators can complicate pick-up or delivery. In addition to the general difficulty of this task, carrying heavy or bulky objects by hand also increases the risk of injury from fatigue, loss of balance, as well as trips and falls. It also increases overall delivery time, and reduces quality of and opportunity for professional customer interactions.

One such task requiring the transport of heavy or bulky objects is the delivery of portable fire extinguishers. Fire codes vary by jurisdiction but nearly all commercial, industrial, and multifamily buildings require comprehensive fire protection. Maritime, aviation, and other transport laws also require that commercial vehicles and vessels also be outfitted with a minimum degree of protection.

A portable fire extinguisher is an element important to any comprehensive fire protection system. They are easy to use and store throughout a structure, and usually the first line of defense in preventing small smoldering fires or electrical problems from turning into a catastrophic loss. As such, fire codes often require a certain number of one or more working portable extinguishers based on use and risk factors of a particular site. Additional protection devices above and beyond fire code requirements are also installed by occupants, owners, or managers. These devices may be provided for peace of mind, for insurance reasons, for additional or redundant protection of sensitive equipment, for preventing small fires from reaching extremely flammable or toxic materials, or a number of other reasons.

SUMMARY

A wearable equipment carrier comprises a first receptacle for retaining a first set of equipment, a lower load bearing section, and an upper load stabilizing section. The lower load bearing section includes a belt for detachably securing the first receptacle to a lower abdominal region of a person. The belt is engaged with a middle portion of the first receptacle for transferring a majority of weight in the first receptacle through the belt to the lower abdominal region during a time that the belt is secured to the person. The upper load stabilizing section includes a first shoulder strap for orienting and laterally stabilizing the first receptacle substantially along a forward walking direction. The first shoulder strap has a forward end for engaging with a top portion of the first receptacle, and a distal end for engaging with a bottom portion of the first receptacle.

A wearable heavy equipment carrier comprises a first receptacle for retaining a first set of equipment, a second receptacle for retaining a second set of equipment, a lower load bearing section, and an upper load stabilizing section. The lower load bearing section includes a belt for detachably securing the first receptacle and the second receptacle to a lower abdominal region of a person. The belt engages with a first middle portion of the first receptacle and a first middle portion of the second receptacle for transferring a majority of weight of the first set of equipment and the second set of equipment through the belt to the lower abdominal region during a time that the belt is secured to the person. The upper load stabilizing section includes a first shoulder strap and a second shoulder strap for orienting and laterally stabilizing the first receptacle and the second receptacle substantially along a forward walking direction. The first shoulder strap has a first forward end for engaging with a first top portion of the first receptacle, and a first distal end for engaging with a first bottom portion of the first receptacle. The second shoulder strap has a second forward end for engaging with a second top portion of the second receptacle, and a second distal end for engaging with a second bottom portion of the second receptacle.

DETAILED DESCRIPTION

In transporting equipment between a delivery vehicle and a site, a service representative frequently must negotiate crowded or damaged streets, sidewalks, curbs, and the entrance to a site. Once inside the site, the representative can also encounter closed doors, stairs, narrow passageways, busy lobbies, and crowded elevators. When carrying heavy or bulky equipment by hand or sling, the representative does not always have hands free to perform various other duties. For example, the representative can be engaged in conversation via mobile phone or radio requiring hands to be free for holding the communication device and/or taking notes. The representative may also be the primary agent of the service company, and is thus encouraged or required by the employer to greet customers in a professional and courteous manner.

Even when not interacting with others, performing such tasks can be difficult without continually shifting, setting down, and lifting the equipment. For example, negotiation of closed doors provides ample opportunity for unnecessary muscle fatigue or injury. In this example, when carrying equipment by hand or sling, a representative will typically bend down, set one part down to free a hand for operating a door handle, then bend again to pick the equipment up again once the door is open. This constant carrying, shifting, and lifting causes unnecessary muscle fatigue and increases the risks of injury. The following figures show example embodiments of an apparatus that can be used to aid a service representative in performing various job duties and increasing efficiency while simultaneously reducing fatigue and risk of work-related injuries.

Figure 1A:
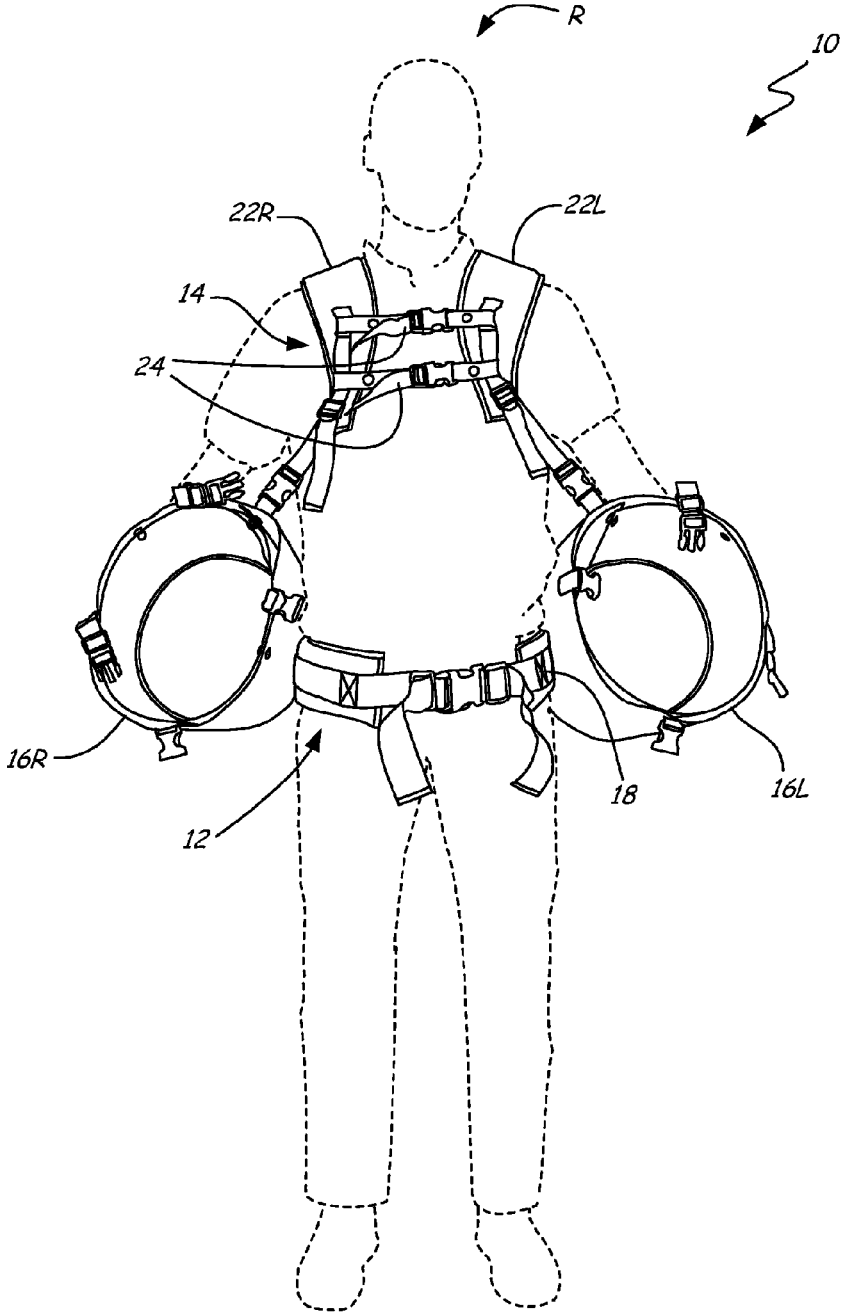
FIG. 1A is a front view of a wearable equipment carrier including two receptacles for retaining one or more sets of equipment.

FIG. 1A shows a front view of wearable equipment carrier 10 worn by service representative R (shown in phantom). Carrier 10 has lower load bearing section 12 and upper load stabilizing section 14. Lower load bearing section 12 includes barrels 16L, 16R, and belt 18. Upper load stabilizing section 14 includes shoulder straps 22L, 22R and chest straps 24.

Figure 4A:
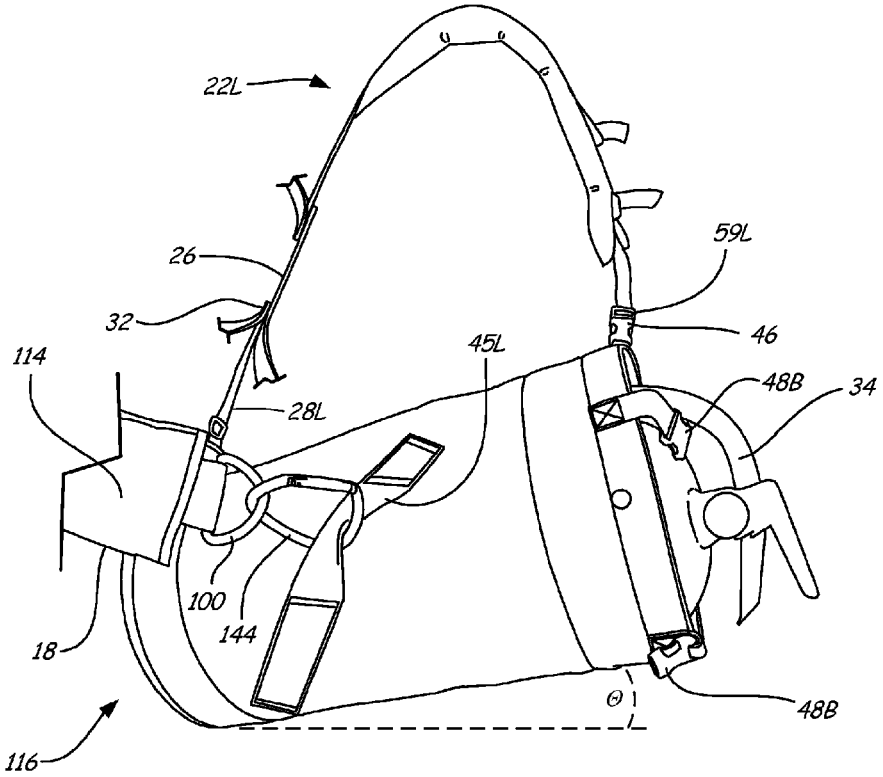
FIG. 4A shows an alternative connection between the receptacle and the belt.

Carrier 10 includes two receptacles engaged with lower section 12 and upper section 14, each for retaining a set of equipment. In this example, the receptacles are barrels 16L and 16R, each adapted to retain a fire extinguisher, such as are shown in FIGS. 1C and 4A). Carrier 10 is donned in a manner similar to a backpack or a pack for carrying hiking gear, with arms of representative R being placed through spaces between shoulder straps 22 and barrels 16. In these examples, carrier 10 can be detachably secured to the body at belt 18 and chest bands 24. Unlike a backpack or golf bag, shoulder straps 22L, 22R do not bear and transmit a majority of the weight carried in respective barrels 16L and 16R through the shoulders, but rather the weight is supported primarily through belt 18.

Some firefighters use a system whereby an extinguisher is retained by a plurality of locking or buckled straps, and carried by a handle or as an over-the-shoulder sling. Such a system generally works well for the particular needs of firefighters, but is not readily adaptable to the service and delivery industry. While service personnel must be physically capable of lifting and carrying heavy objects as part of their job duties, most workers do not reach the high levels of strength and fitness more typical of firefighters. And firefighters are generally exempt from many occupational safety laws designed to protect the average worker. Thus, a sling type device is not appropriate for service and delivery personnel, and may only marginally reduce their risk of repetitive stress and lower back injuries compared to carrying items by hand. In many cases, the higher potential for improper use of shoulder-type carriers may actually exacerbate risks of injury and damage.

Generally speaking, a person carrying heavy or bulky equipment by hand or shoulder bears much of the weight of that in the muscles, bones and ligaments in the upper portion of the body, including the neck, shoulders, arms, and hands. Many shoulder based devices also require use of the hands and arms to stabilize the load, preventing the user from performing other tasks including opening doors and holding handrails. The user can still be required to repeatedly lift, set down, and adjust a shoulder mounted sling several times per day. Undesired stress can also accrue in the lower back muscles, due to long term use as well as repeated bending, lifting, and setting down of the equipment to free the hands for other job tasks.

Unlike slings, golf bags, or messenger bags, carrier 10 can be adapted to carry loads on both sides of the body simultaneously without the risk of entangling two separate devices. Leg and core muscles are also stronger and more stable relative to back, shoulder, and arm muscles that would be utilized with a shoulder sling. For example, a shoulder carrier or sling requires representative R to vertically lift weight a significant distance to place a strap over the shoulder. Even if a longer sling were placed over the opposing shoulder, the weight still would be transmitted through the upper body. The required length of the sling strap can also cause undesired swinging of the cargo, increasing the risk of property damage and personal injury.

Wearable equipment carrier 10 provides vertical and lateral support of equipment using at least one point of support on each of a top portion, a middle portion, and a bottom portion of barrels 16L, 16R. As such, a majority of the mass of equipment in barrels 16 is vertically supported proximate the hip bones of representative R through connections with belt 18 on the middle portions of barrels 16L and 16R. This lowers the center of gravity of carrier 10 and thus also lowers the overall center of gravity of representative R. Shoulder straps 22L and 22R, primarily offer lateral balance and stability via multiple connections to upper and lower portions of barrels 16L and 16R. As described below, barrels 16 can be configured into a desired ergonomic position by adjusting the lengths of belt 18, and various straps to fit a particular body shape, size, and stature.

Figure 2A:
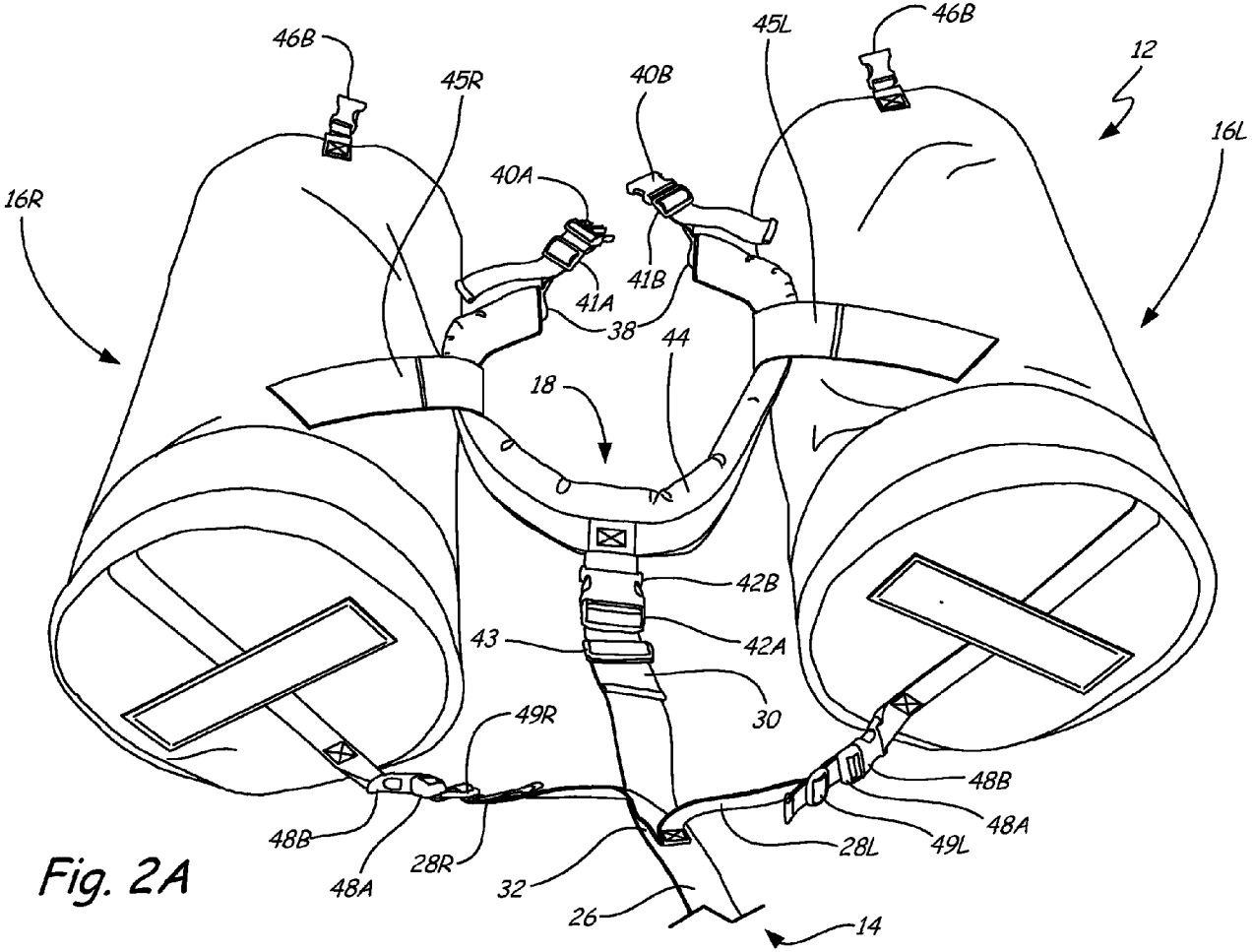
FIG. 2A is a lower section of the carrier including two receptacles and a belt.

In lower load bearing section 12, a majority of the weight of equipment disposed in one or more receptacles, such as barrels 16L, 16R, is supported via slidable engagement with belt 18. In this example, belt 18 is adjustable in length and can be secured about the hips or lower abdominal region of representative R via clasps, loops, or other fasteners as seen in FIG. 2A. Once the length of belt 18 is adjusted and secured to a particular user, barrels 16L, 16R then can be moved along the length of belt 18 to situate them proximate either hip such that they are substantially aligned with a forward walking direction. Any suitable combination of elements can be used to slide barrels 16L, 16R, but two examples are shown and discussed below.

Upper load stabilizing section 14 includes shoulder straps 22L, 22R and chest straps 24. Generally, respective forward ends of shoulder straps 22L and 22R are detachably secured to respective top sections of barrels 16L and 16R. At their respective distal ends, shoulder straps 22L and 22R are linked directly or indirectly to the bottom portion of respective barrels 16L and 16R. This will be seen and explained in detail with the rear view of carrier 10 shown in FIG. 1B. Chest straps 24 also help to laterally secure and stabilize shoulder straps 22L and 22R. When engaged to straps 22L and 22R, chest straps 24 further limits the lateral position and inertia of barrels 16L and 16R by restricting lateral displacement of straps 22L and 22R relative to the person's body and to each other.

In this example, shoulder straps 22L and 22R have adjustable lengths to accommodate users of different body types. Chest straps 24 are similarly adjustable in size and position. It will also be recognized that carrier 10 can be fabricated in several adjustable sizes for comfort, safety, cost, or other reasons. For example, carrier 10 can be designed in small, medium, and large sizes such that the adjustable lengths of belt 18, shoulder straps 22L, 22R, chest straps 24 and additional straps vary over a narrower range to better accommodate users in each predefined range of relative body sizes, types, and statures. Examples of belt 18, shoulder straps 22L, 22R, and chest straps 24 are described below.

Even when generally aligned with the forward walking direction of representative R, barrels 16L, 16R can undergo a substantial amount of twisting and swaying relative to the body. This can occur with the rhythmic pace of walking, as well as when negotiating obstacles such as stairs and doorways. Excessive lateral displacement also affects the lateral center of gravity of carrier 10, which makes it far more difficult for representative R to maintain balance. Thus, securing upper load stabilizing section 14 to the top and bottom sections of barrels 16 as described above can reduce this motion and lateral inertia of the equipment. This helps representative R keep balance and footing, which decreases fatigue and the risk of injury. Together, these elements provide lateral stability and security at the front of representative R by preventing the top sections of barrels 16L and 16R from swinging away from each other. It also limits interference by barrels 16 while representative R performs other activities requiring use of hands or arms.

Figure 1B:
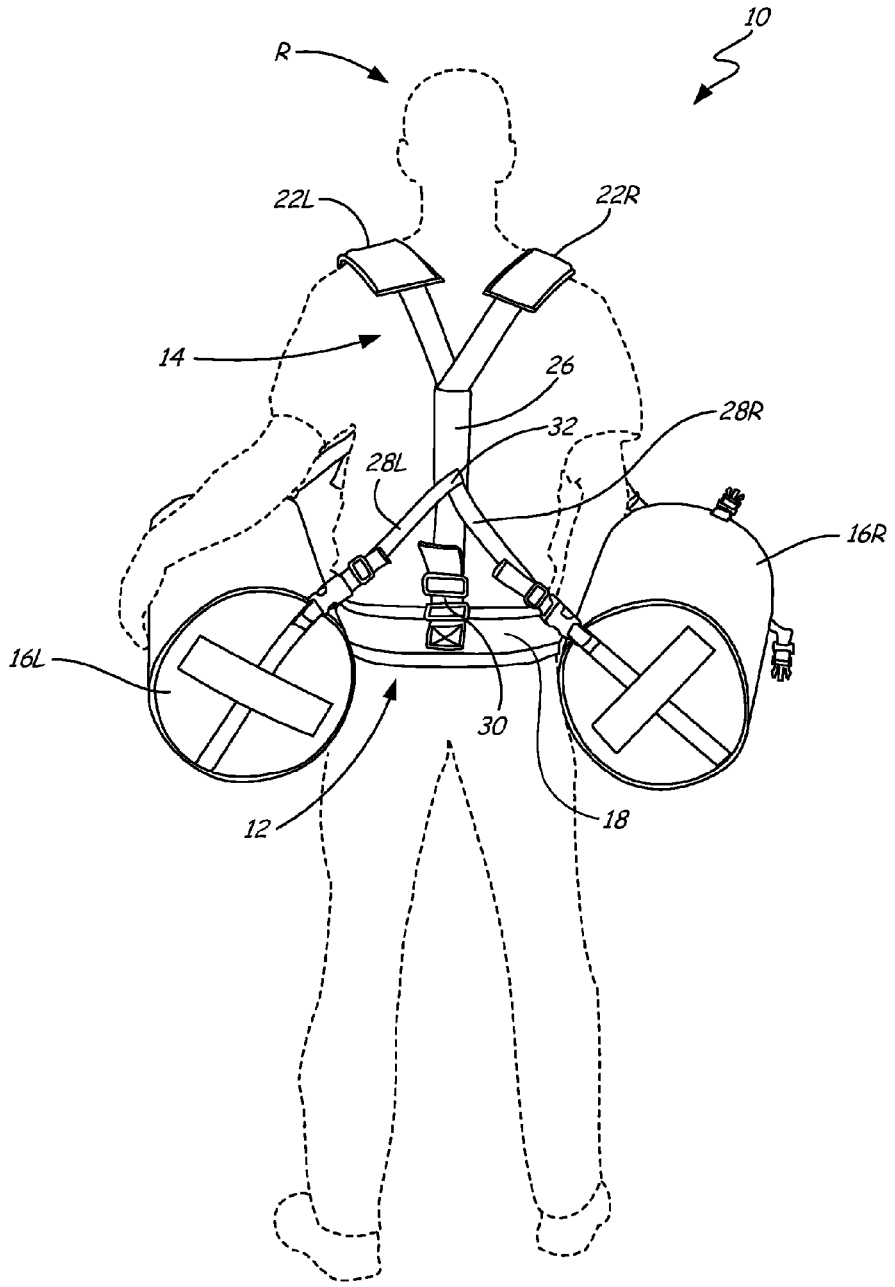
FIG. 1B is a rear view of the wearable equipment carrier in FIG. 1A.
Figure 1C:
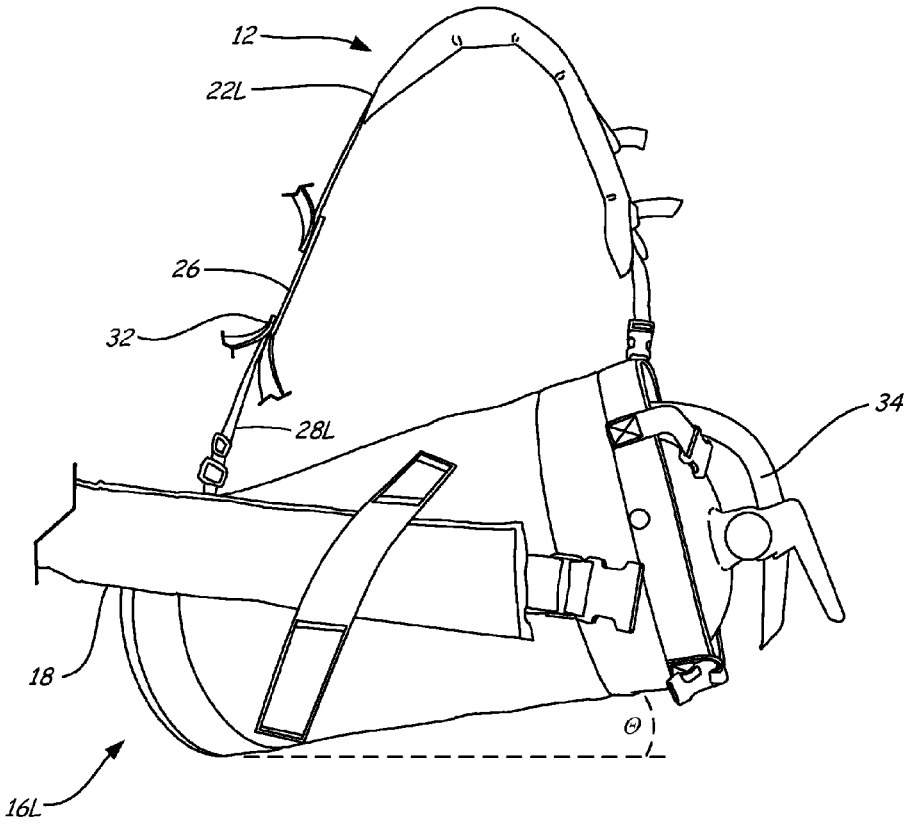
FIG. 1C is a side view of the carrier of FIGS. 1A-1B and showing a portable fire extinguisher placed in one of the receptacles.

FIG. 1B is a rear view of equipment carrier 10 worn by service representative R (shown in phantom). As in FIG. 1A, carrier 10 has lower load bearing section 12 with barrels 16L, 16R, and belt 18. Upper load stabilizing section 14 includes shoulder straps 22L, 22R with shoulder connector 26, barrel connectors 28L, 28R, and belt connector 30 joined at junction 32.

As described with reference to FIG. 1A, forward ends of straps 22L, 22R are secured to respective top sections of barrels 16L and 16R to retain them close to the body of representative R. At their respective distal ends, shoulder straps 22L and 22R are indirectly secured to the bottom portion of respective barrels 16L and 16R via shoulder connector 26, junction 32, and respective barrel connectors 28L, 28R. Shoulder straps 22L, 22R extend over the respective left and right shoulders of representative R and converge into shoulder connector 26.

One end of shoulder connector 26 is sewn or otherwise fixed to distal ends of shoulder straps 22L, 22R. At its lower end, shoulder connector 26 is fixed to barrel connectors 28L and 28R, as well as to belt connector 30 at junction 32. Connectors 26, 28L, 28R, and 30 cooperate at junction 32 to balance and redistribute the various forces experienced by representative R while carrying equipment in barrels 16L and 16R. In this example, the connectors converge to form an X or a cross at junction 32. This orientation effectively converts the combination of straps and connectors into several integrated supports for barrels 16, which balances the support and lateral forces as close as possible to the center of gravity of representative R.

For example, shoulder straps 22L and 22R form a Y with shoulder connector 26, which is held substantially along the spine when carrier 10 is properly adjusted. This retains shoulder straps 22, preventing them from sliding off the shoulders. Shoulder connector 26 also forms an inverse Y with barrel connectors 28L and 28R, preventing the respective bottom sections of barrels 16L and 16R from departing significantly away from each other and from the body of representative R.

Distal ends of shoulder straps 22 also work in conjunction with shoulder connector 26 and belt connector 30. This is to prevent a portion of belt 18 worn about the person's back from slipping down the lower back, potentially causing the angle of barrels 16 to be raised relative to the ground (shown in FIG. 1C). The Y-support formed by shoulder straps 22, shoulder connector 26, and belt connector 30 keep the back of belt 18 at a level around the middle of the person's lower back. This helps to maintain barrels 16 at or near the target angles relative to the ground, as shown and discussed with respect to FIG. 1C. In addition, if belt 18 does slip too low, such as when the lengths of shoulder straps 22 or belt connector 30 are improperly adjusted, representative R can pull forward on shoulder straps 22 to pull up the back of belt 18 via belt connector 30. Then, without removing carrier 10, representative R or someone providing assistance can then make necessary strap length adjustments to secure carrier 10, as described below with reference to FIGS. 3A-3B.

Upper load stabilizing section 14 thus supports a small portion of the equipment's weight at the bottom sections of barrels 16L and 16R indirectly through shoulder straps 22L and 22R. This is primarily in furtherance of providing lateral stability to barrels 16L and 16R, helping to retain barrels 16 in the orientations described herein by distributing and balancing the forces between the various elements of carrier 10.

As described, keeping barrels 16L and 16R close to the body helps improve muscle efficiency and balance by reducing the effort expended by representative R. Junction 32 allows the various connectors and straps to cooperate with one another to limit stray lateral and vertical motion of barrels 16. Otherwise, that excess inertia must be borne and countered by the user's muscles. For example, the bottom of barrel 16 may be temporarily displaced, such as when representative R accidentally strikes a door or quickly turns a corner. Both the degree and frequency of lateral displacement are minimized because such forces and momentum are quickly transferred through the connectors via junction 32 and absorbed over the entirety of belt 18 and shoulder straps 22. In this manner, upper load stabilizing section 14 minimizes undesired displacement of barrels 16, keeping them at a safe enough distance to prevent fatigue, as well as to limit inertia in the event of inadvertent contact with the body.

As noted, FIG. 1B shows shoulder straps 22L, 22R linked to shoulder connector 26. Alternatively, shoulder straps 22L and 22R can be linked directly at their distal ends to the bottom portion of respective barrels 16L and 16R, eliminating the need for shoulder connector 26. For example, shoulder straps 22L and 22R can alternatively include respective barrel connectors 28L and 28R attached directly to their respective distal ends for directly securing shoulder straps 22L and 22R to the respective bottom portions of barrels 16L, 16R. In other alternative embodiments, shoulder straps 22L, 22R are secured to barrel connectors 28L, 28R via direct connection to junction 32.

FIG. 1C is a side view of portable fire extinguisher 34 carried in wearable equipment carrier 10. As in FIGS. 1A and 1B, carrier 10 has lower load bearing section 12 and upper load stabilizing section 14. In this view, lower load bearing section 12 includes barrel 16L, and belt 18, while upper load stabilizing section 14 includes shoulder strap 22L, shoulder connector 26, barrel connector 28L, belt connector 30, and junction 32. Barrel 16L is oriented relative to the ground at angle 8 when loaded with extinguisher 34. Additional straps are omitted from this figure and shown as broken lines to better illustrate the listed straps and connections to barrel 16L.

As described above, belt 18 vertically supports a middle portion of barrel 16L, while shoulder strap 22L laterally supports and retains the axial orientation of barrel 16L substantially in a forward walking direction. A forward end of shoulder strap 22L is connected to the top portion of barrel 16L, while a distal end of strap 22L is connected to the bottom portion via shoulder connector 26, barrel connector 28L, and junction 32. This connection to the bottom portion can be seen in detail in FIGS. 1B and 2A.

Carrying equipment in barrels 16 helps representative R to maintain his or her balance while negotiating doorways, stairs, handrails, and other obstacles with heavy and/or bulky equipment. When transporting equipment, such as extinguisher 34, carrier 10 is configured to position the center of gravity of the equipment in the middle section slightly below the longitudinal midpoint of barrels 16. The equipment's center of gravity is then positioned by carrier 10 approximately between each hip bone and the middle of each thigh. This position can vary depending on the weight balance of the equipment being transported.

Overall, carrier 10 improves balance, reduces unnecessary muscle use, and improves the experience of carrying and delivering heavy and/or bulky equipment. This configuration also reduces the risk and severity of muscle injury, as well as from trips and falls. Placement of barrels 16 in this area generally causes a majority of the weight of extinguishers 34 to be borne primarily through belt 18 by the muscles in the legs and lower abdominal core with much less reliance on shoulder, back, and arm strength. Laterally securing extinguishers 34 close to the body of representative R as described above also appears to limit large side-to-side deviations in the user's center of gravity, which also reduces muscle use to maintain and correct course.

Carrier 10 also promotes safe and efficient loading and unloading of extinguishers 34 by minimizing bending and lifting. In addition to keeping the hands free for operating doors and using handrails, carrying the bulk of weight near the hips and legs reduces the height over which extinguisher 34 must be lifted because both hands of representative R are free to load and unload barrel 16L. This can reduce muscle strain and the likelihood of lower back injuries from bending and lifting one extinguisher 34 to deal with another. For example as shown in FIGS. 1A-1B, the top opening of barrels 16L, 16R is located near the natural resting position of the hands and arms. Thus the handle of extinguisher 34 sits within the range of motion of the arms of representative R when being loaded or unloaded. Representative R also has both hands free to remove a first extinguisher 34 from its installed position, such as mounted on a wall in a building, and place it directly into either barrel 16L or 16R with a minimum of bending and lifting. A second extinguisher 34 can then be removed and placed into the second barrel 16 without representative R needing to bend or lean to set down the first extinguisher 34.

Also as seen in this figure, vertical and lateral support elements also cooperate to orient barrels 16L, 16R at a shallow angle 8 relative to the ground or other walking surface when extinguisher 34 is disposed therein. This further assists with loading, unloading, and transporting of equipment. In certain embodiments, angle θ is between about 5° and about 25°. In other embodiments, angle θ is between about 10° and about 20°. In yet other embodiments, angle θ is about 15°.

In certain embodiments, carrier 10 is adjustable to fit the body shape of representative R. In certain of these embodiments, carrier 10, including shoulder straps 22 can be adjustable in length as described below, to target the angles in the above ranges as desired. Depending on the weight distribution of extinguishers 34, among other factors, barrel 16L may be at an angle less than or greater than θ when barrel 16L is empty. However, in many cases where the different straps and connectors are properly adjusted to fit carrier 10 to representative R, the angle of barrel 16L when empty will not vary more than about 10° in either direction from θ for loaded barrel 16L as detailed above. For example, as pressure vessels, extinguishers 34 are relatively bottom heavy and thus can result in a slightly higher angle θ relative to different types of equipment.

As described, angle θ reduces the overall amount of muscle exertion by service representative R when transporting, loading, and unloading extinguishers 34 from barrels 16. Supporting a majority of weight in the middle portion of barrel 16L, and adjusting the lengths of various connectors on carrier 10 as described below retains extinguisher 34 in the target angle ranges described above. These adjustments also keep the center of gravity of barrel 16L around its middle portion proximate belt 18. At the same time, the target angles are large enough to allow equipment to rest at the base of barrels 16 without sliding out. This can alleviate the need for a cover, allowing barrels 16 to be readily loaded and unloaded. However, it will be appreciated that in some alternative embodiments, a cover, integral with or separable from barrels 16 can be placed over the otherwise open top of barrels 16 for added security or protection of the equipment, such as during adverse weather conditions. It will also be appreciated that carrier 10 can be adapted to transport other sets of equipment with different weight distributions and thus a cover or other securing means may be useful in such instances.

As described above, service representative R delivers extinguishers 34 or other heavy or bulky equipment to a variety of sites. Examples include commercial offices, multifamily residential dwellings, and industrial manufacturing plants. Vehicles and vessels operated in a public or commercial capacity can also be required to install portable fire extinguishers before being lawfully commissioned. Once installed, most portable extinguishers 34 must be periodically serviced and/or replaced. Service activities, which may be performed with portable equipment on the service vehicle or at a central facility, will usually involve transporting the equipment back to the service vehicles from the site.

Portable extinguishers, such as extinguishers 34 vary in size and weight based on the particular application and installation site. For example, when charged with fire extinguishing or suppression agent, many portable extinguishers weigh on the order of 9 kg (~20 lb). Carrier 10 can be adapted to support the weight of many heavier extinguishers as well. However, occupational safety and workers' compensation laws in most jurisdictions regulate the maximum size and weight that representative R can carry under standard working conditions. Though carrier 10 can be easily adapted to transport equipment weighing more than about 9 kg (20 lb) in each receptacle, such devices are usually mounted on a fire tree, dolly, or other wheeled conveyance for regulatory reasons.

Extinguishers 34 are frequently used to put out or prevent the spread of small fires without the need to call for assistance or activating more aggressive measures. It will be apparent from this description that that the term fire "extinguisher" is used in a broad sense. Some portable devices suppress or inhibit the spread of fire rather than extinguish it, but such distinctions are not relevant here.

Barrels 16L and 16R can be readily adapted to retain other portable fire protection devices regardless of purpose or composition. They can also be adapted for other heavy or bulky equipment. Carrier 10 can be adapted around virtually any other heavy or bulky equipment item otherwise carried by hand, sling, bag, or other such devices.

FIG. 2A shows example lower load bearing section 12 partially connected to upper section 14, with barrels 16L, 16R, belt 18, shoulder connector 26, barrel connectors 28L, 28R, belt connector 30, junction 32. belt strap 38, belt clasp tab portion 40A, belt clasp receiving portion 40B, belt length adjusters 41A, 41B, belt connector clasp tab portion 42A, belt connector clasp receiving portion 42B, belt connector length adjuster 43, abdominal padding 44, belt loops 45L and 45R, shoulder strap clasp receiving portions 46B, barrel connector clasp tab portions 48A, barrel connector clasp receiving portions 48B, and barrel connector length adjusters 49L, 49R.

Similar to FIG. 1B, upper section 14 is shown as being detachably engaged to lower section 12 and barrels 16 at the region of carrier 10 normally worn at the user's back. Barrel connectors 28L, 28R each have clasp tab portions 48A engaged with receiving portions 48B on respective bottom portions of barrels 16L, 16R. Belt connector clasp portions 42A, 42B also link connector 30 to belt 18 at about the middle of the lower back.

Belt strap 38 provides the basic foundation for belt 18. Belt clasp tab portion 40A is also disposed on one end of belt strap 38 and belt clasp tab receiving portion 40B is disposed on the opposite end of strap 38 to detachably secure belt 18 around the user's torso. The effective length of belt 18 can be changed using length adjusters 41A, 41B to customize carrier 10 for a particular user.

In this example, belt strap 38 is readily available black woven nylon SCUBA webbing. In certain embodiments, strap 38 is approximately 50 mm (2 inches) wide, and a length of about 157 cm (62 inches) is used. These dimensions are generally sufficient to extend substantially around the waist or hips of a number of different individuals of varying size and stature by providing enough excess material to properly fit belt 18 using length adjusters 41. However, it will be appreciated that belt 18 can have a lesser or greater length as appropriate for different potential users.

Belt clasp 40 is shown as a standard thermoplastic apparatus with bendable hinges on a tab portion 40A detachably engaging with receiving portion 40B. Belt length adjusters 41 can include a well-known sliding mechanism to gather and redirect a segment of strap 38, causing it to overlap with another segment, reducing or increasing the effective length of belt 18. Alternatively, belt clasp 40 and belt length adjusters 41 can be replaced by any suitable system for securing and customizing belt 18 to a particular person. The dimensions and materials used for belt strap 38, belt clasp 40, and belt length adjusters 41 can vary depending on several considerations including relative availability, cost, strength, the equipment to be transported, as well as other occupational and aesthetic preferences of the manufacturer, customer, and/or representative. For example, belt clasp 40 can alternatively be a loop, buckle, tie or other similar device.

Belt connector clasp receiving portion 42B cooperates with tab portion 42A disposed at a distal end of belt connector 30 to detachably secure belt 18 to upper stabilizing section 14. Receiving portion 42A is disposed near the midpoint of belt 18 to align with placement of belt connector 30 near the midpoint of the wearer's lower back. Belt connector 30 can be lengthened or shortened by moving the strap through belt connector length adjuster 43. Relative orientations of belt 18 and belt connector 30 are shown and explained with reference to FIGS. 1B and 3A.

This example shows a portion of belt 18 having both padding 44 and belt strap 38 slidably engaged with barrels 16L and 16R through loops 45L and 45R. In certain embodiments, abdominal padding 44 extends along at least 60% of the fully extended length of belt 18. In other embodiments, padding 44 extends along at least 70% of the fully extended length of belt 18. In yet other embodiments, padding 44 extends along at least 80% of the fully extended length of belt 18. These relative lengths ensure there is sufficient padding 44 in and around belt loops 45 when barrels 16 are moved along belt 18 to align with the hips. The thickness of padded section 44 leaves very little clearance between loops 45 and the outer surfaces of barrels 16. Reducing clearance through loops 45 increases frictional resistance and prevents undesired sliding of barrels 16 along belt 18.

Belt 18 includes abdominal padding 44, sewn or otherwise affixed along at least part of the length of belt strap 38. Abdominal padding 44 is a volume of foam or other soft, sturdy material wrapped and sewn within an outer layer of high strength woven material or webbing. Padded section 44 stiffens belt strap 38, holding belt 18 securely about the hips or lower abdomen with a minimum of sliding and twisting. This helps retain barrels 16L and 16R in the correct forward walking orientation relative to the hips, and minimizes inertial contact between barrels 16 and the body.

In this example, padding 44 includes a shell of lightweight polypropylene webbing enclosing readily available high density rubber or synthetic foam. In certain embodiments, the foam has a thickness of about 19 mm (0.75 inches). Again, the thickness can be increased or decreased depending on the properties of the chosen material, as well as to provide additional comfort to the user. Additionally, or alternatively, abdominal padding 44 can be any combination of lightweight textile or other materials capable of equalizing and cushioning the forces of barrels 16 against the body. While this example shows abdominal padding 44 sewn along belt strap 38, alternative embodiments include belt strap 38 passing freely through an interior volume of abdominal padding 44 when barrels 16 are empty. Other alternative embodiments include two length-adjustable sections of belt strap 38 fixed to opposing ends of abdominal padding 44.

Here, loops 45L and 45R are fixed or sewn at approximately respective longitudinal midpoints of barrels 16L and 16R. In this example, either end of a short segment of high-strength nylon SCUBA webbing is sewn to an outer surface proximate respective middle portions of each of barrels 16L and 16R, leaving an unsewn part of the segment to define respective belt loops 45L and 45R. Belt 18, including belt strap 38 and abdominal padding 44, is thus slidably engaged with barrels 16L and 16R respectively through loops 45L and 45R, as seen in part in FIG. 1C.

As shown in FIGS. 1A-1C, upper load stabilizing section 14 is detachably secured to top and bottom portions of barrels 16 via shoulder strap clasp receiving portions 46B and barrel connector clasp receiving portions 48B proximate the respective top and bottom edges of barrels 16. Clasp portions 46B, 48B or their equivalents can be fixed via a short length of nylon SCUBA webbing similar to shoulder straps 22 or belt strap 38. Alternatively, they can be fixed directly to barrels 16 without SCUBA or other webbing.

At least one of the shoulder strap clasp portions 46B proximate the open end of barrel 16L detachably engages with corresponding clasp tab portion 46A disposed on a forward end of shoulder strap 22L (shown in FIG. 3A) to support and laterally stabilize the top portion of barrels 16. Similarly, barrel connector clasp receiving portions 48B proximate the bottom of barrels 16 detachably engage with corresponding clasp tab portions 48A on distal ends of barrel connectors 28. As can be seen here and in more detail in FIG. 3A, barrel connectors 28L, 28R include respective barrel connector length adjusters 49L, 49R to help position, support, and laterally stabilize bottom portions of barrels 16L, 16R In other examples, barrels 16 can also include detachable covers or lids to prevent damage as described above. Such covers can include clasp tab portions around the cover perimeter for engagement with corresponding receiving portions 46B disposed around the opening of barrels 16.

In this example, belt loops 45 are disposed at an angle of about 45° relative to respective longitudinal axes of cylindrical barrels 16. This angle can vary depending on the size and weight distribution of equipment to be transported by carrier 10. The angle can also vary based on the lengths of various straps and belt 18, due to the size or stature of a particular person wearing carrier 10. A different vertical support configuration may be required to compensate for these or other adjustments. The number and location of other supports, such as clasp portions 46B and/or 48B on barrels 16, can also vary due to the vertical and lateral support requirements proximate the top and bottom edges. For example, barrels 16 can include more than one clasp receiving portion 48B on its bottom portion to facilitate multiple direct and/or indirect connections with distal ends of shoulder straps 22.

Figure 2B:
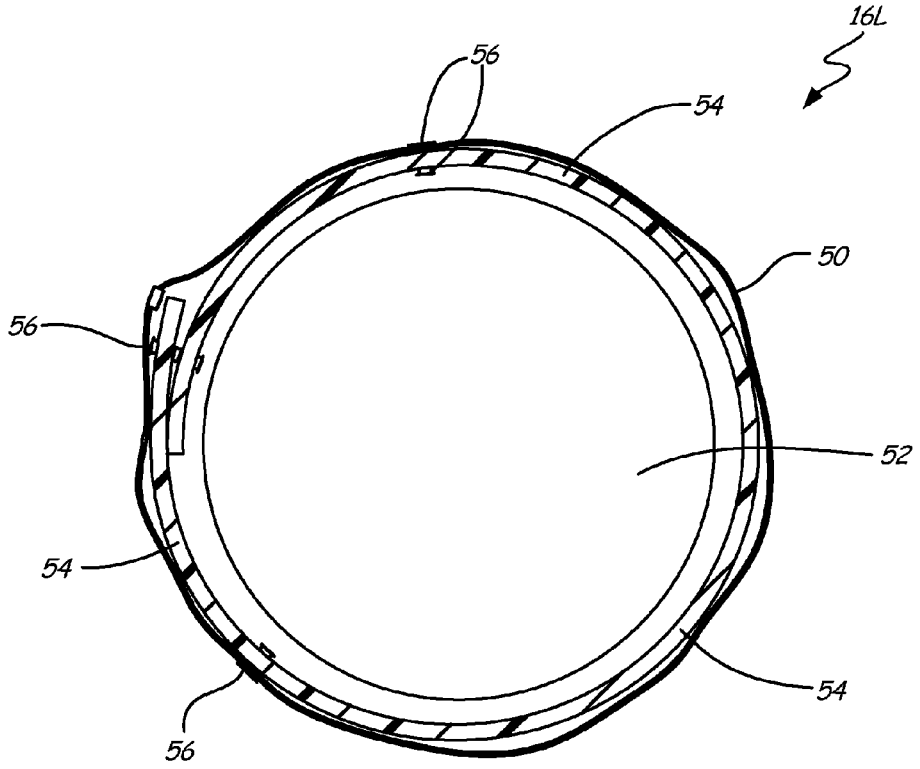
FIG. 2B is a view looking into a receptacle from above the top opening.

FIG. 2B is a view looking into empty barrel 16L from the top opening and includes shell 50, circular base 52, bolster 54, and snap fasteners 56. Shell 50 is fabric or other sturdy, flexible material wrapped and sewn into the desired shape to accommodate one or more selected pieces of equipment. Here, for example, shell 50 is 600 denier polyester fabric sewn with nylon thread into a semi-rigid cylinder with an open top end. However, shell 50 can instead be any flexible, high-strength, tear resistant material capable of being sewn or otherwise formed into the cylinder or any other alternative shape.

Base 52 and bolster 54 provide supplemental strength and rigidity to further ease loading, unloading, and transport of equipment in barrel 16L. Circular base 52 reinforces the base of semi-rigid shell 50. Base 52 is a reinforced paperboard or thermoplastic sheet capable of supporting at least the mass of a 9 kg (20 lb) cylinder. In this example, paperboard base 52 is secured between two layers of shell 50. Alternatively, base 52 is collapsible or otherwise removable when extinguisher 34 (not shown in FIG. 2B) or other equipment is not being transported in barrel 16L.

Bolster 54 provides additional support to the side walls of barrel 16L. In this example, bolster 54 is inserted and secured along the inside walls of shell 50 by snap fasteners 56, thus making bolster 54 removable. In this example, bolster 54 is a hard but flexible, high-strength thermoplastic sheet, such as polyvinyl chloride (PVC), rolled generally into a shape resembling an open cylindrical tube. The cylindrical shape of bolster 54 is maintained by engaging snap fasteners 56 between different portions of bolster 54 and an interior surface of shell 50. Alternatively, bolster 54 is retained between two layers of shell 50, such as by snaps, buttons, interlocking hook-and-loop fasteners or similar elements. For example, bolster 54 may have a dedicated pocket between two layers of shell 50, allowing bolster 54 to slide in and out as needed.

Bolster 54 helps retain an opening sufficient to load extinguisher 34 without using hands or other means to hold open the top of barrel 16L. In certain alternative embodiments, shell 50 is sufficiently strong and rigid to support and retain an opening for placement of extinguisher 34 (not shown in FIG. 2B) without base 52 and/or bolster 54.

Barrel 16L can also be modified in several other ways to accommodate different users and equipment. For example, one or more inserts or dividers can be temporarily or permanently placed to adapt barrel 16L for multiple smaller extinguishers. Several smaller extinguishers can also be encased in neoprene or other protective sleeves before placement in barrel 16L. It will be apparent that barrel 16R (shown in FIGS. 1A-1B) will have elements substantially identical to barrel 16L. Relative placement or orientation of these elements can be modified to secure barrel 16R on the opposite side of carrier 10. It will also be apparent that barrels 16 can be adapted with different shapes, materials, and/or securing means in order to safely transport heavy and/or bulky equipment with a shape or weight distribution different from extinguisher 34.

Figure 3A:
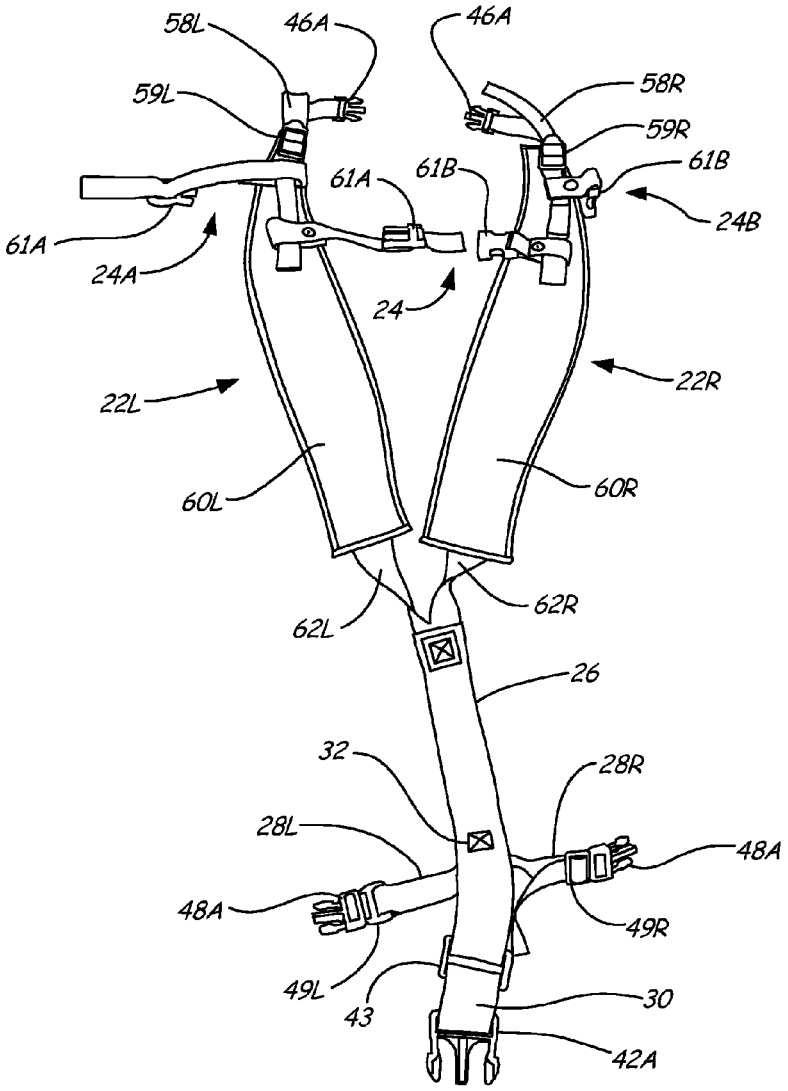
FIG. 3A illustrates an example of an upper section of the carrier including two shoulder straps, and a junction of several connectors.

FIG. 3A shows upper load stabilizing section 14 with shoulder straps 22L, 22R, chest strap sections 24A and 24B, shoulder connector 26, barrel connectors 28L, 28R, belt connector 30, and junction 32. Belt connector 30 has belt connector clasp portion 42A and belt connector length adjuster 43. Barrel connectors 28L, 28R include barrel connector clasp tab portions 48A, and length adjusters 49L, 49R. Shoulder straps 22L, 22R include shoulder connector clasp tap portions 46A, forward bands 58L, 58R, shoulder strap length adjusters 59L, 59R, padded sections 60L, 60R, and distal bands 62L, 62R. Chest bands 24 have chest band sections 24A and 24B each with clasp portions 61A, 61B.

While lower load bearing section 12 supports the majority of the equipment weight as shown above, carrier 10 also laterally stabilizes barrels 16 close to the body of representative R via upper load stabilizing section 14. Shoulder straps 22L and 22R include respective forward bands 58L, 58R and distal bands 62L, 62R sewn or otherwise fixed to respective forward and distal ends of padded sections 60L and 60R. Padded sections 60 are similar in construction to abdominal padding 44 in belt 18, but shaped to comfortably distribute forces over the shoulder, neck and chest. Like padding 44, shoulder padding 60 includes foam or padding enclosed within a polypropylene or similar cover.

Shoulder straps 22L and 22R each have shoulder connector clasp tab portions 46A disposed on forward bands 58L and 58R. These detachably engage with a corresponding receiving clasp portion 46B on the top portion of each barrel 16 (shown in FIG. 2A). Like other parts of carrier 10, forward bands 58L, 58R also include respective length adjusters 59L, 59R to adapt shoulder straps 22 to the needs a particular user, and helping to ensure barrels 16 are retained approximately at the target angle θ shown in FIG. 1C. Also cooperating to retain barrels 16 at the target angle are distal bands 62L, 62R converging into shoulder connector 26, which extends to junction 32. Shoulder connector 26 cooperates with barrel connectors 28L, 28R, and belt connector 30 as described above with respect to FIGS. 1B and 1C.

Shoulder straps 22 also each include sections of at least one chest band 24A or 24B. In this example, chest strap sections 24A and 24B are lengths of adjustable nylon SCUBA webbing detachably engaged to approximately a midpoint of each padded section 60. Each pair of chest band sections 24A and 24B include an interlocking pair of chest band clasp tab and receiving portions 61A, 61B. When clasps 61 are engaged, chest straps 24 extend substantially across the user's chest, cooperating with shoulder straps 22L, 22R to help secure carrier 10 to representative R and minimize lateral motion of barrels 16. In certain embodiments, the vertical positions of chest straps 24 are adjustable along straps 22 to accommodate preferences of various users. This can be done, for example, by securing chest strap sections 24A and 24B through loops on padded sections 60. Chest straps 24 can also be made with different lengths and placed in different positions depending on the size and stature of the user.

Figure 3B:
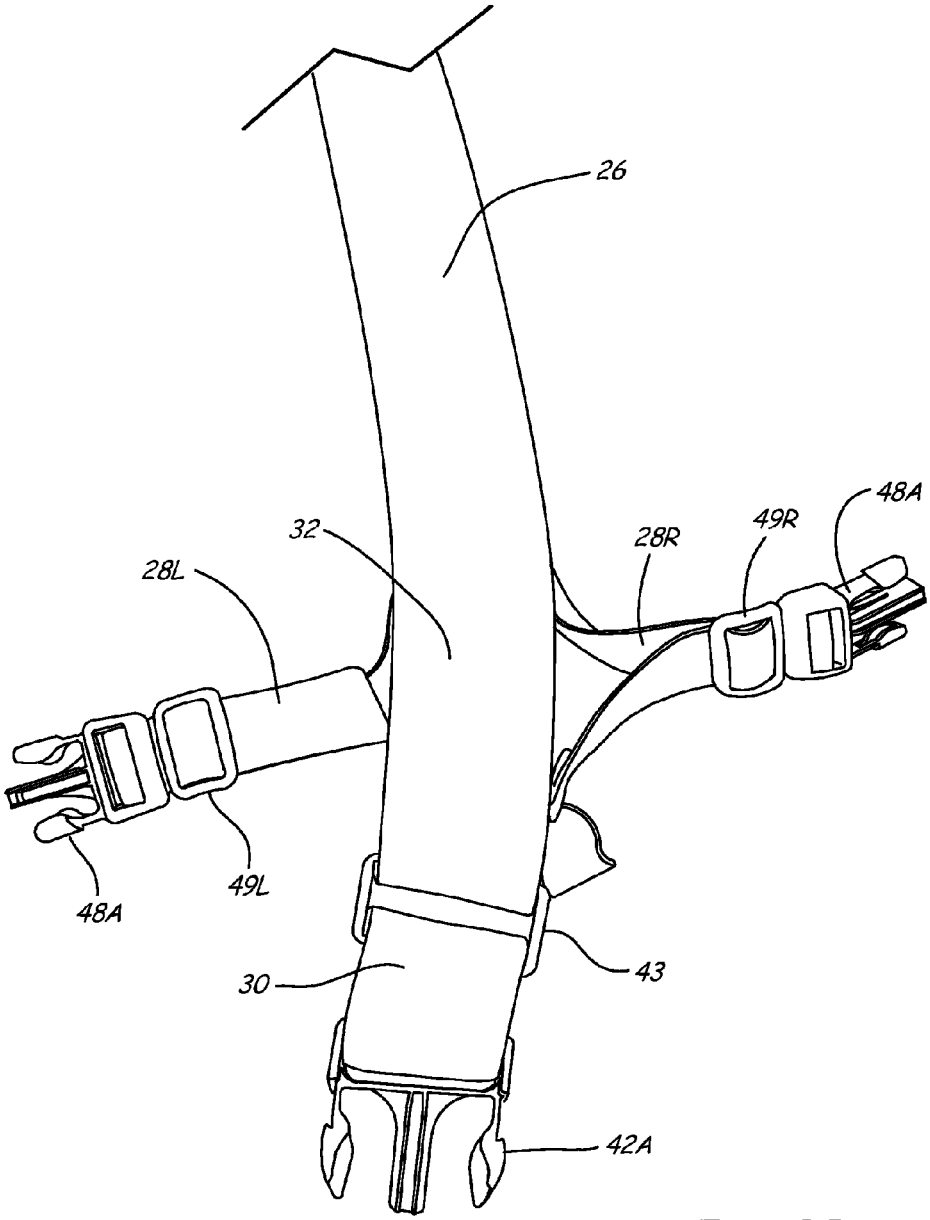
FIG. 3B is a detailed view of the junction from FIG. 3A.

FIG. 3B includes shoulder connector 26, barrel connectors 28L, 28R, belt connector 30, and junction 32. Barrel connectors 28L, 28R each have one clasp tab portion 48A and one length adjuster 49, while belt connector 30 includes clasp tab portion 42A and length adjuster 43.

Connectors 26, 28L, 28R, 30 are bands made from SCUBA nylon or a similar material sewn or otherwise secured to one another to define junction 32. As seen in FIG. 3B, barrel connectors 28L, 28R each include a clasp tab portion 48A and a length adjuster 49. When clasp tab portions 48A are engaged with receiving portions 48B on bottom portions of barrels 16 (shown in FIG. 2A), junction 32 links barrel connectors 28 to distal ends of shoulder straps 22 via shoulder connector 26. Belt connector 30 includes clasp portion 42A and length adjuster 43 to detachably and adjustably link junction 32 to belt 18 as discussed above.

During a time when carrier 10 is properly adjusted and secured to the person, junction 32 sits proximate the middle of a user's lower back. Thus, as described above with reference to FIG. 1B, the various connectors define a plurality of X- and Y-supports through junction 32, which cooperate with fasteners and clasps to retain barrels 16 near the target angle θ shown above.

In conjunction with barrel connectors 28L, 28R and belt connector 30, the single center strap for shoulder connector 26 minimizes lateral displacement of the bottom portions of barrels 16 via connection with barrel connectors 28. This can occur in such situations as where the equipment in barrels 16 is bottom heavy, and thus the bottom portion is susceptible to significant lateral displacement. Belt connector 30 also holds up the back of belt 18 through shoulder connector 26 as shown and described with respect to FIG. 1B.

In addition to belt 18 and shoulder straps 22, barrel connectors 28L, 28R, include length adjusters 49L, 49R, while and belt connector 30 includes length adjuster 43. Lengths of these connectors can be adjusted as described above to optimize the orientation of these various supports for particular user carrying equipment in barrels 16. Lengths are adjusted such that barrels 16 are arranged into a target configuration such as are shown in FIG. 1C. This can include retaining barrels proximate the hips in a forward walking direction, and supporting barrels 16 at target angle θ relative to a flat walking surface, such as the ground, a floor, or a stairwell.

FIGS. 3A-3B shows junction 32 as having one attached shoulder connector 26. A single shoulder connector 26 substantially aligns with the spine and corresponds to the body's natural support structure. It also reduces outward displacement and swinging of bottom portions of one barrel 16 by using the opposing barrel 16 to restrain and laterally stabilize these bottom portions.

However, it will be apparent that shoulder connector 26 is not limited to being a single strap. For example, distal bands 62 of shoulder straps 22 (shown in FIG. 3A) can alternatively converge directly at junction 32, in which case, shoulder connector 26 is instead an integral part of junction 32. In another example, shoulder straps 22 alternatively extend around the back of the neck of representative R and converge into a neck band with one or more shoulder connector straps linking the neck band to junction 32.

Figure 4B:
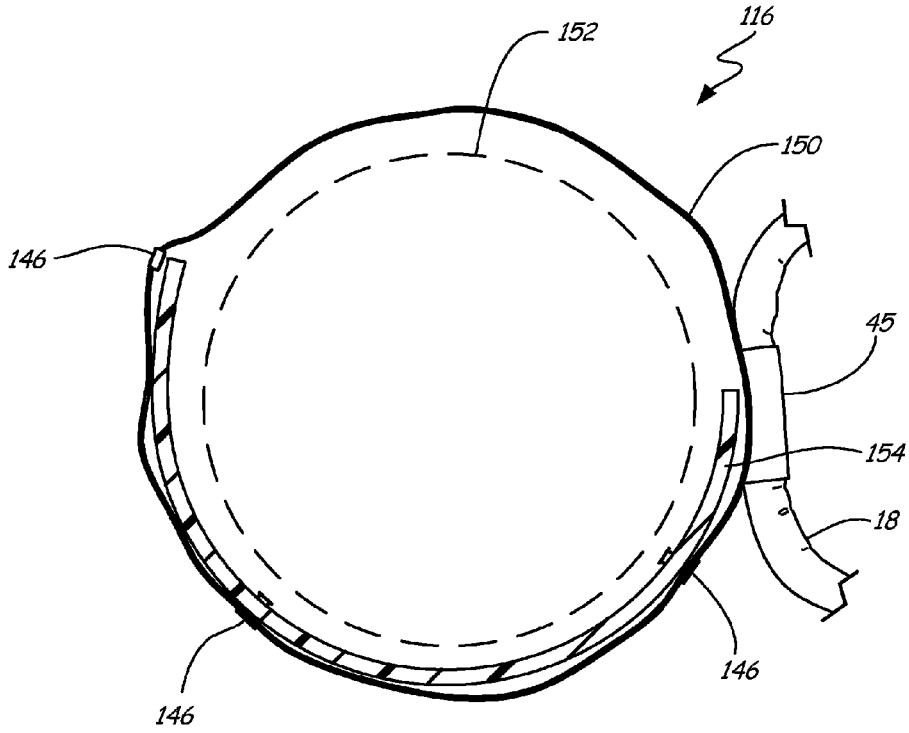
FIG. 4B is a view looking into an alternative embodiment of a receptacle.

In addition to producing carrier 10 in various sizes to fit persons of different size and stature, several other adjustments and modifications can be made to carrier 10. Two examples of these modifications are illustrated in FIGS. 4A and 4B. FIG. 4A shows an alternative connection between the middle portion of barrel 16 and belt 18 as compared to FIG. 1C. The figure includes belt 18, left shoulder strap 22L, shoulder connector 26, left barrel connector 28L, junction 32, extinguisher 34, left belt loop 45L, shoulder strap clasp 46, clasp receiving portions 48B, left shoulder strap length adjuster 59L, D-ring 100, padded section 114, barrel 116, and carabineer 144.

D-rings 100 or other sturdy supports are permanently affixed to padded section 114. Belt loop 45L also includes one or more carabineers 144 or other similar fasteners to detachably secure the middle portion of barrel 116 to belt 18 in a manner similar to barrel 16 in FIG. 1C. One or more D-rings 100 can be permanently fastened, bonded, or sewn to padded section 114.

In this alternative embodiment, barrel 116 can be readily detached from the three attachment points at its top, middle, and bottom portions and be replaced by another receptacle customized for different equipment while still secured to a person. The middle portion can be detached from belt 18 by disengaging carabineer 144 from D-ring 100. When clasp 46 at the top portion and a clasp (not shown) at the bottom portion are also disengaged, barrel 116 can be removed from carrier 10. In the example embodiment seen in FIG. 2A, belt 18 can be pulled through belt loop 48 to detach the middle of barrel 16. However, unlike the embodiment of barrel 116 shown here in FIG. 4A, the middle portion of barrel 16 in FIG. 2A cannot be detached while carrier 10 is secured to the person.

In these alternative embodiments, however, sufficient padding can be provided around D-rings 100 and/or carabineers 144. This is in part to prevent the weight of extinguishers or other equipment from placing excessive pressure on the abdominal region, which would otherwise cause discomfort and/or injury. Padded section 114 can also be one or more sections slidable along the length of belt strap 38 (shown in FIG. 2A) instead of being sewn thereto. It will also be recognized that the placement of D-rings 100 and carabineer 144 can be swapped such that a D-ring is placed on barrel 116.

FIG. 4B is a view looking into alternative barrel 116. Barrel 116, which includes snap connectors 146, shell 150, base 152, and bolster 154, is an alternative embodiment of barrel 16 shown in FIG. 2B. In certain alternative embodiments, bolster 154 extends only around a portion of the perimeter of shell 150. For example, in embodiments having cylindrical barrels 116, bolster 154 extends around no more than about 50% of the inner circumference of semi-rigid shell 150. In other embodiments, bolster 154 extends around no more than about 25% of the circumference of barrel 116. Smaller embodiments of bolster 154 can be positioned in barrel 116 and secured with snaps 146 so that they support extinguisher 34 when the user is standing with carrier 10 properly adjusted and secured.

In additional alternative embodiments, bolster 154 can be easily removed by sliding it out of barrel 116. For example, instead of snap connectors 146, bolster 154 can be retained in a pocket or sleeve built into shell 150. Reducing or removing some or all of bolster 154 permits an upper portion of shell 150 to collapse down when barrel 116 is empty. In certain of these embodiments, base 152 is also foldable or removable to further reduce the size of barrel 116 when stowed or otherwise not loaded with equipment. This and other similar adjustments to carrier 10 can reduce its footprint once the delivery is completed, simplifying the return trip, as well as storage of carrier 10 in a delivery vehicle.

Other variations and modifications can be made to carrier 10. For example, barrels 16, belt 18 and/or shoulder straps 22 can include additional receptacles or loops to carry small hand tools, phones, radios, writing implements, notepads, or other helpful items. Apparatus 10 can also be adapted to include a single receptacle instead of two.

Although the present invention has been described with reference to preferred embodiments, workers skilled in the art will recognize that changes may be made in form and detail without departing from the spirit and scope of the invention.

The invention claimed is:

1. A wearable equipment carrier comprising:

a first receptacle for retaining a first set of equipment;

a lower load bearing section including a belt for detachably securing the first receptacle to a lower abdominal region of a person, the belt engagable with a middle portion of the first receptacle for transferring a majority of weight in the first receptacle through the belt to the lower abdominal region during a time that the belt is secured to the person; and an upper load stabilizing section including a first shoulder strap for orienting and laterally stabilizing the first receptacle substantially along a forward walking direction, the first shoulder strap having a forward end that engages directly with a top portion of the first receptacle, and a distal end that engages directly with a bottom portion of the first receptacle.

2. The carrier of claim 1, wherein the carrier is detachably secured to the lower abdominal region, the lower load bearing section and the upper load stabilizing section cooperating to orient the first receptacle retaining the first set of equipment at an angle θ relative to a flat walking surface.

3. The carrier of claim 2, wherein the angle θ is between about 5° and about 25°.

4. The carrier of claim 2, wherein the angle θ is between about 10° and about 20°.

5. The carrier of claim 1, wherein the distal end of the first shoulder strap engages directly with the bottom portion of the first receptacle through a shoulder connector.

6. The carrier of claim 1, wherein the distal end of the first shoulder strap engages directly with the bottom portion of the first receptacle though a barrel connector.

7. A wearable equipment carrier comprising:

a first receptacle for retaining a first set of equipment;

a second receptacle for retaining a second set of equipment;

a lower load bearing section including a belt for detachably securing the first receptacle and the second receptacle to a lower abdominal region of a person, the belt engagable with a first middle portion of the first receptacle and a first middle portion of the second receptacle for transferring a majority of weight of the first set of equipment and the second set of equipment through the belt to the lower abdominal region during a time that the belt is secured to the person; and an upper load stabilizing section including a first shoulder strap and a second shoulder strap for orienting and laterally stabilizing the first receptacle and the second receptacle substantially along a forward walking direction, the first shoulder strap having a first forward end that engages directly with a first top portion of the first receptacle, and a first distal end that engages directly with a first bottom portion of the first receptacle, and the second shoulder strap having a second forward end that engages directly with a second top portion of the second receptacle, and a second distal end that engages directly with a second bottom portion of the second receptacle.

8. The carrier of claim 7, wherein the carrier is detachably secured to the lower abdominal region, the lower load bearing section and the upper load stabilizing section cooperating to orient the first receptacle retaining the first set of equipment at an angle θ relative to a flat walking surface.

9. The carrier of claim 8, wherein the angle θ is between about 5° and about 25°.

10. The carrier of claim 8, wherein the angle θ is between about 10° and about 20°.

11. The carrier of claim 7, further comprising a chest strap for detachably securing the first and second shoulder straps over the person.

12. The carrier of claim 11, wherein a first portion of the chest strap is secured along a length of the first shoulder strap, and a second portion of the chest strap is disposed along a length of the second shoulder strap.

13. The carrier of claim 7, wherein the belt is slidably engaged with the first receptacle.

14. The carrier of claim 7, wherein the belt is detachably engaged with the first receptacle.

15. The carrier of claim 7, wherein the first receptacle is a first cylindrical barrel having a first semi-rigid shell with a first opening proximate the first top portion of the first receptacle, and the second receptacle is a second cylindrical barrel having a second semi-rigid shell with a second opening proximate the second top portion of the second receptacle.

16. A wearable equipment carrier comprising:

a first receptacle for retaining a first set of equipment;

a second receptacle for retaining a second set of equipment;

a lower load bearing section including a belt for detachably securing the first receptacle and the second receptacle to a lower abdominal region of a person, the belt engagable with a first middle portion of the first receptacle and a first middle portion of the second receptacle for transferring a majority of weight of the first set of equipment and the second set of equipment through the belt to the lower abdominal region during a time that the belt is secured to the person; and an upper load stabilizing section including a first shoulder strap and a second shoulder strap for orienting and laterally stabilizing the first receptable and the second receptacle substantially along a forward waling direction, the first shoulder strap having a first forward end that engages directly with a first top portion of the first receptacle, and a first distal end that engages directly with a first bottom portion of the first receptacle, and the second shoulder strap having a second forward end that engages directly with a second top portion of the second receptacle, and a second distal end that engages directly with a second bottom portion of the second receptacle;

wherein the respective distal ends of the first shoulder strap and the second shoulder strap converge in to a single shoulder connector.

17. The carrier of claim 16, wherein the shoulder connector is fixed to a junction for detachably securing the shoulder connector to the first bottom portion of the first receptacle connector and to the second bottom portion of the second receptacle through a second receptacle connector.

18. The carrier of claim 16, wherein the shoulder connector is detachably secured proximate a midpoint of the belt.

19. The carrier of claim 16, wherein the first cylindrical barrel further comprises a bolster reinforcing at least a portion of an interior surface of the first semi-rigid shell.

20. The carrier of claim 19, wherein the bolster extends around at least about 50% of an inner circumference of the first cylindrical barrel.

* * * * *